US007650993B2

(12) United States Patent
Bawabe

(10) Patent No.: US 7,650,993 B2
(45) Date of Patent: Jan. 26, 2010

(54) CORELESS-COIL SHOCK TUBE PACKAGE SYSTEM

(75) Inventor: A. Jonathan Bawabe, Columbia, CT (US)

(73) Assignee: Ensign-Bickford Aerospace & Defense Company, Sinsbury, CT (US)

( * ) Notice: Subject to any disclaimer, the term of this patent is extended or adjusted under 35 U.S.C. 154(b) by 865 days.

(21) Appl. No.: 11/202,529

(22) Filed: Aug. 12, 2005

(65) Prior Publication Data

US 2006/0144279 A1 Jul. 6, 2006

Related U.S. Application Data

(60) Provisional application No. 60/601,458, filed on Aug. 13, 2004.

(51) Int. Cl.
*B65D 85/00* (2006.01)
*C06C 5/00* (2006.01)

(52) U.S. Cl. ..... 206/388; 102/275.1

(58) Field of Classification Search ..... 206/317, 206/388, 389, 398, 400, 407, 409–419, 497, 206/225–226, 591, 521, 3, 371; 102/202.3, 102/502, 275.1; 242/360, 470
See application file for complete search history.

(56) References Cited

U.S. PATENT DOCUMENTS 1,631,756 A * 6/1927 Olin ..... 102/202.12
2,123,996 A * 7/1938 Hunt ..... 102/202.12
2,393,221 A * 1/1946 Mercer ..... 242/164
3,590,739 A 7/1971 Persson
3,909,504 A * 9/1975 Browne ..... 174/524
4,166,418 A * 9/1979 Calder, Jr. ..... 102/301
4,328,753 A 5/1982 Kristensen et al.
4,955,471 A * 9/1990 Hirose et al. ..... 206/303
5,494,152 A * 2/1996 Sobczak et al. ..... 206/3
5,597,973 A 1/1997 Gladden et al.
5,996,777 A * 12/1999 Capers, III ..... 206/3
6,006,671 A * 12/1999 Yunan ..... 102/275.11
6,272,996 B1 8/2001 O'Brien et al.

* cited by examiner

*Primary Examiner*—Stephen Garbe
*Assistant Examiner*—Kaushikkumar Desai
(74) *Attorney, Agent, or Firm*—Cantor Colburn LLP

(57) ABSTRACT

A coreless-coil shock tube package system includes a "coreless" bundle of shock tubing, meaning that the tubing is not wrapped around a spool. The bundle may be a generally cylindrical coil of shock tubing. Optionally, two washer-like end plates abut the ends of the tubing coil for axial support. A layer of shrink-wrap or other polymer film partially covers the coil and end plates. A detonator is attached to one end of the tubing and lies tucked into the coil, through an end plate, for storage and transport. An igniter is attached to the tubing's other end. In use, the detonator is removed from the coil and attached to an explosive device. Then, the package is pulled away from the detonator and explosive, thereby uncoiling the tubing through the end plate for deployment. The igniter is actuated for igniting the shock tubing and activating the detonator and explosive.

7 Claims, 5 Drawing Sheets

CORELESS-COIL SHOCK TUBE PACKAGE SYSTEM

CROSS REFERENCE TO RELATED APPLICATIONS

This application claims the benefit of U.S. Provisional Application Ser. No. 60/601,458 filed Aug. 13, 2004, herein incorporated by reference in its entirety.

FIELD OF THE INVENTION

The present invention relates to igniting devices and systems for explosives and, more particularly, to fuse cord and packaging for fuse cord.

BACKGROUND OF THE INVENTION

Shock tubes are a type of fuse cord or blasting cord used in non-electric blast initiation systems. Shock tube was originally described in U.S. Pat. No. 3,590,739 to Persson. Shock tubing typically comprises an elongated, hollow, flexible, small-diameter tube, the inner surface of which is coated with a reactive substance, e.g., a thin layer of detonating or deflagrating explosive composition. Most commonly, this composition consists of a mixture of HMX and aluminum powder. Later shock tube designs such as disclosed in U.S. Pat. No. 4,328,753 to Kristensen encompass multiple plastic layers to provide improved tensile strength and abrasion resistance.

In commercial blasting applications, the shock tubing provides a signal transmission device to transmit a signal to multiple blasting caps in mining or quarrying applications. When initiated, the interior coating of the shock tube transmits a low energy shock wave that travels down the interior of the tube, but without breaching the tube sidewall. A detonator affixed to the end of the tubing is initiated by the shock wave, thereby setting off an attached explosive charge. The U.S. Army has developed shock tube-based initiation systems because of their relative safety. In particular, since the system is non-electric, it is not affected by stray electrical currents so cannot be accidentally initiated by electrical signals. Also, the system does not require special electrical blasting machines as would be required if an electric blasting cap system was used.

In commercial applications, a firing device containing a percussion primer is typically used to initiate the shock tube. For military applications, a self-contained system is desirable. In military systems, an end fitting can be used to position a percussion primer on the end of the shock tube. This type of fitting and initiation system is disclosed in U.S. Pat. No. 6,272,996 B1 to O'Brien et al.

In the field, a spring loaded firing pin device is typically attached to the assembly and used to fire the percussion primer for initiating the shock tube.

More recently, products have been developed for the military with the firing device permanently affixed to the shock tube lead in the factory. This results in a totally self-contained initiation system being delivered in one package to the field. This type of initiation system is disclosed in U.S. Pat. application Ser. No. 10/667,042. As disclosed in this application, the firing devices are mounted on the flange of the spool. The shock tubing is wound around the spool and detonator(s) are crimped to the end of the shock tube.

The length of shock tube on a spool can vary from 80 feet to 1,000+ feet. The length of shock tube allows the field blaster to retreat a safe distance between the charge the detonator is initiating and the firing device that initiates the blast.

This system is very robust and useful and has been deployed extensively in military field applications. However the use of a spool (and, of course, box) greatly increases the overall weight and volume of the shock tube package. For covert operations, it is extremely desirable to have a self-contained detonator assembly that is easily carried by a person or one that will fit into a pocket on a vest.

SUMMARY OF THE INVENTION

An embodiment of the present invention relates to a coreless-coil shock tube package system, and to a method for packaging shock tubing. The package system includes a "coreless" bundle of shock tubing, by which it is meant that the tubing bundle is not supported or contained by being wrapped around a spool or other supporting structure. The tubing bundle may be a generally cylindrical (in overall shape) coil of shock tubing. Optionally, two washer-like end caps or plates abut the ends of the tubing coil for helping to support the coil axially. Also, a polymer or plastic, "shrink wrap"-type outer covering partially covers the coil and end plates. Other coverings may be used.

Typically, one end of the tubing (referred to herein as the "inner" end) is positioned at the interior of the coil, and the other end of the tubing (referred to herein as the "outer" end) is positioned on the outside of the coil. Optionally, a detonator is attached to the tubing's inner end and is then tucked into the coil, through one of the end plates, for convenient storage and transport. Also, a percussive initiator device ("igniter") may be attached to the tubing's outer end and secured in place against the outside of the outer covering. In use, the detonator is removed from the coil and attached to an explosive device in a conventional manner. To deploy the tubing, the coil package is pulled away from the detonator and explosive, thereby uncoiling the tubing through the end plate (or though the end of the coil if no end plates are used). Then, the igniter is actuated, igniting the shock tubing, whose interior percussive "signal" in turn actuates the detonator, igniting the explosive.

As should be appreciated, the coreless-coil shock tube package system relies upon the inherent resiliency of the shock tube itself for eliminating the need for a bulky internal core structure, e.g., spool. The polymer outer covering envelops the exterior of the coiled shock tube, resulting in a compact, lightweight package that can be readily carried in a backpack or concealed on one's person.

To manufacture one embodiment of the shock tube package system, the end plates are placed on a mandrel, spaced apart by a distance generally corresponding to the desired length of the shock tube package. (Each end plate has a central hole whose diameter corresponds to the mandrel's diameter.) Then, a desired length of shock tubing is wrapped around the mandrel between the end plates to form a coil. Subsequently, the coil and end plates are at least partially covered by the outer covering, and heat is applied to the covering (if needed), which responds by constricting against the coil. Before the covering is applied, the tubing ends may be positioned or secured for easy access after shrink-wrapping. Then, the mandrel is removed, and an igniter and detonator are attached to the tubing's ends.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
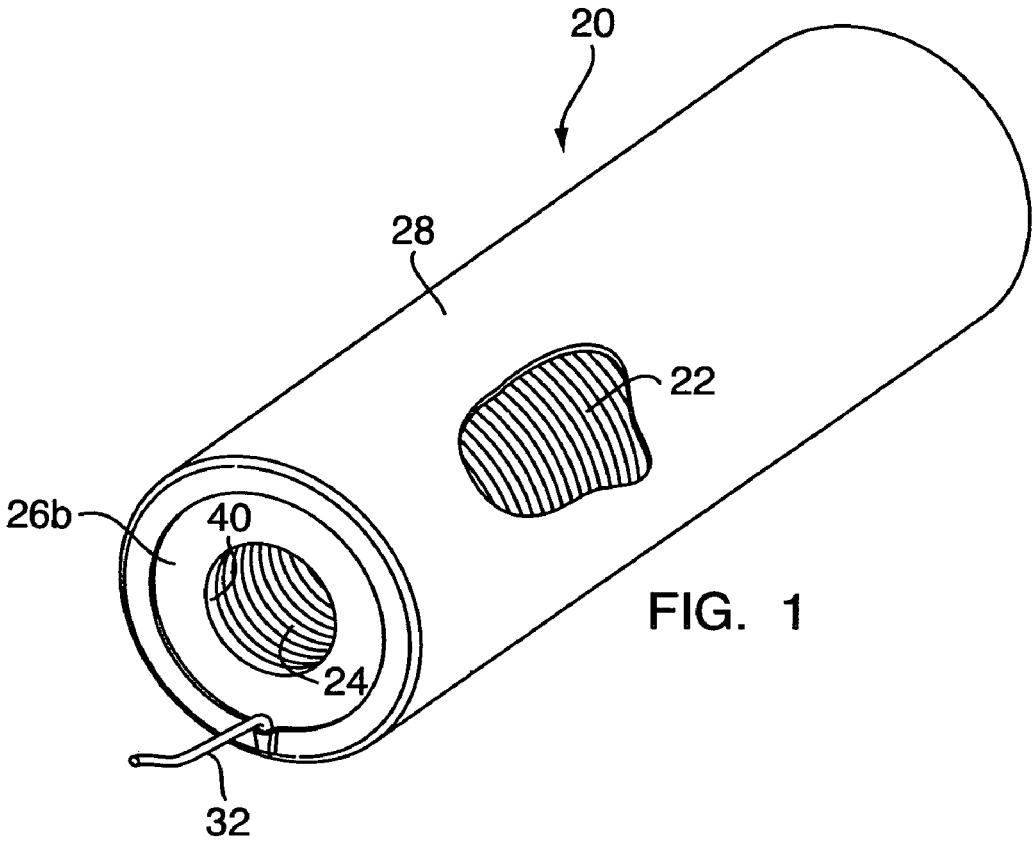
FIG. 1 is a perspective view of a coreless-coil shock tube package system, according to an embodiment of the present invention, showing an "outer" end of the shock tubing.
Figure 2:
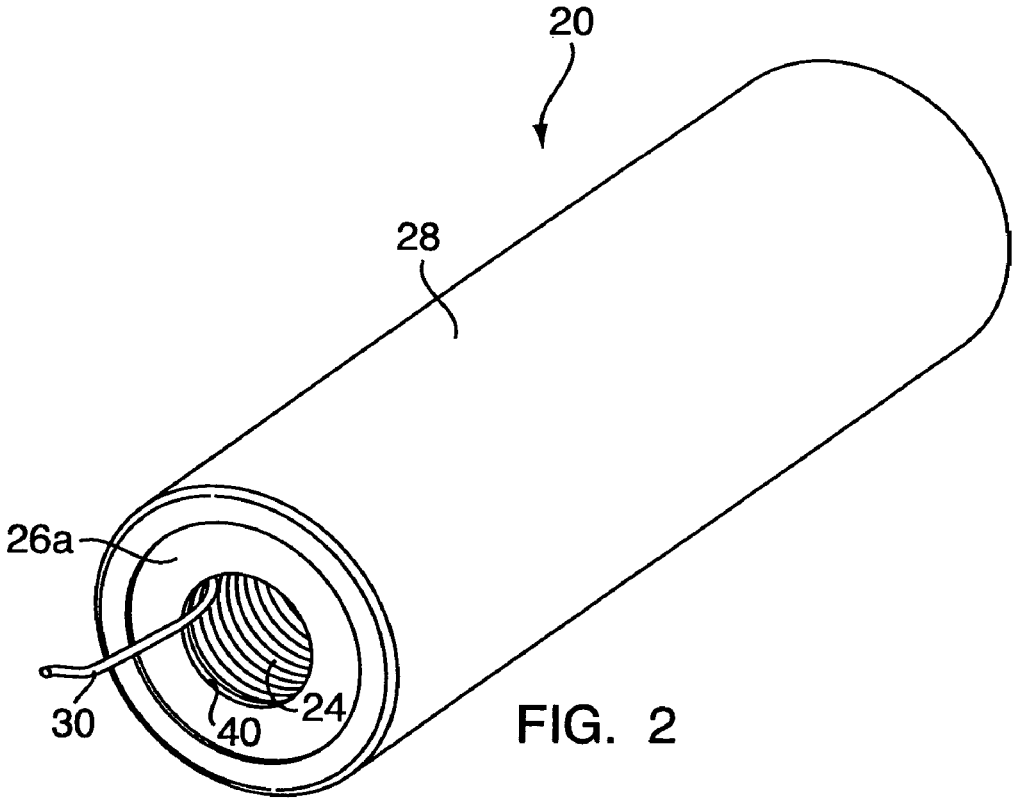
FIG. 2 is a perspective view of the package system showing an "inner" end of the shock tubing.
Figure 3:
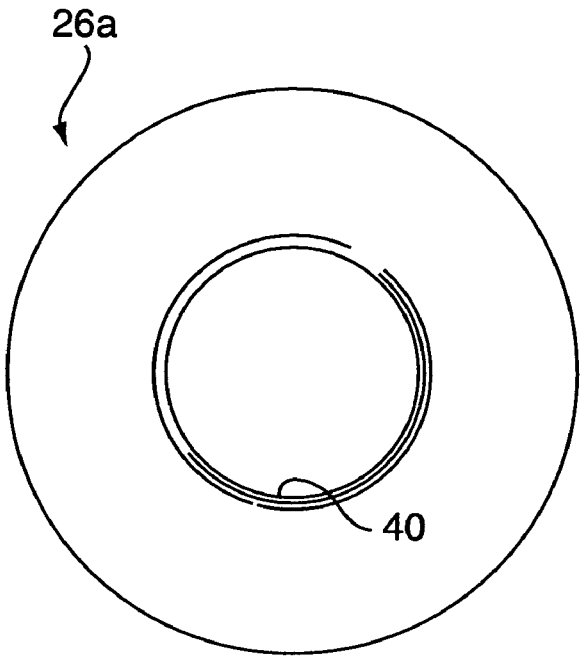
FIGS. 3 and 4 are top plan and side elevation views, respectively, of a first end plate or cap.
Figure 4:
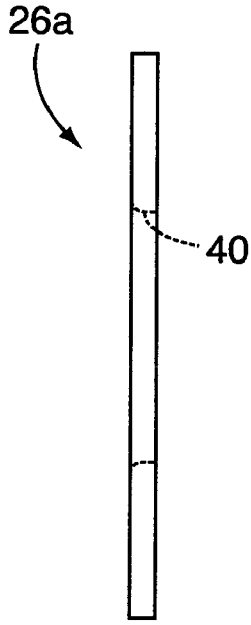
Figure 5:
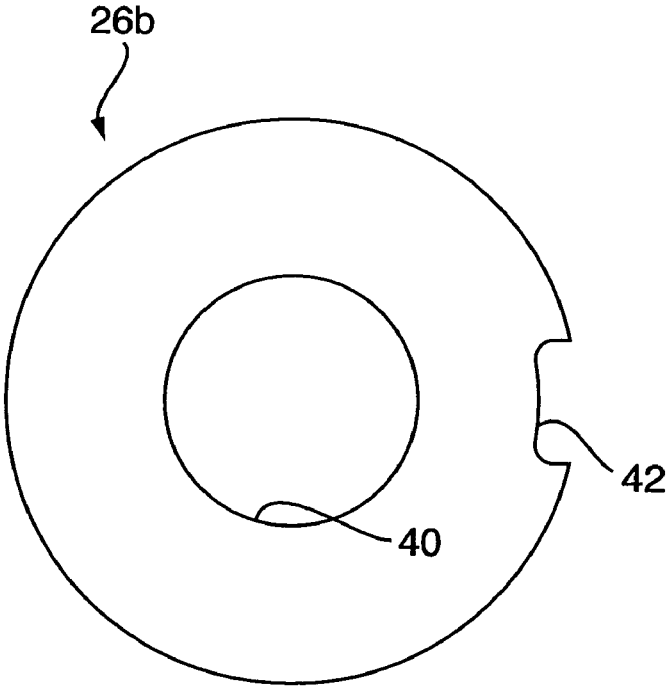
FIGS. 5 and 6 are top plan and side elevation views, respectively, of a second end plate or cap.
Figure 6:
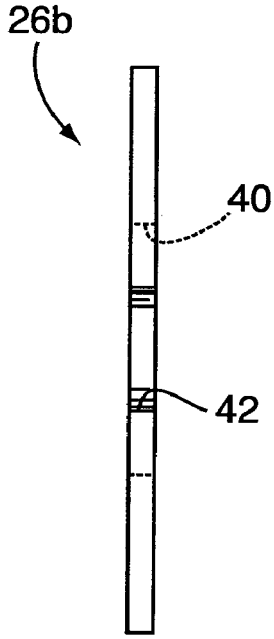
Figure 7:
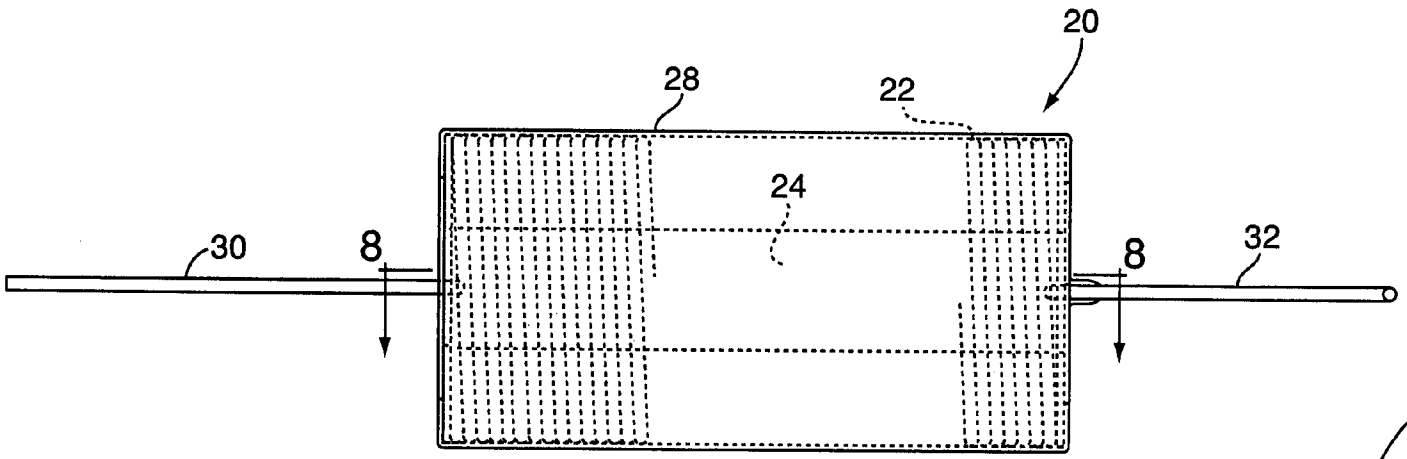
FIG. 7 is a lateral side elevation view of the package system.
Figure 9:
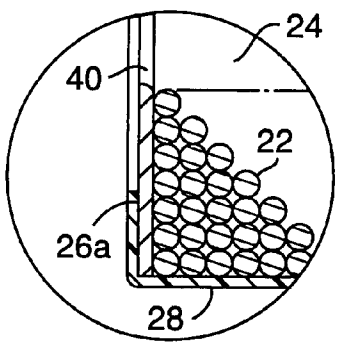
FIG. 9 is a detail view of the package system.
Figure 8:
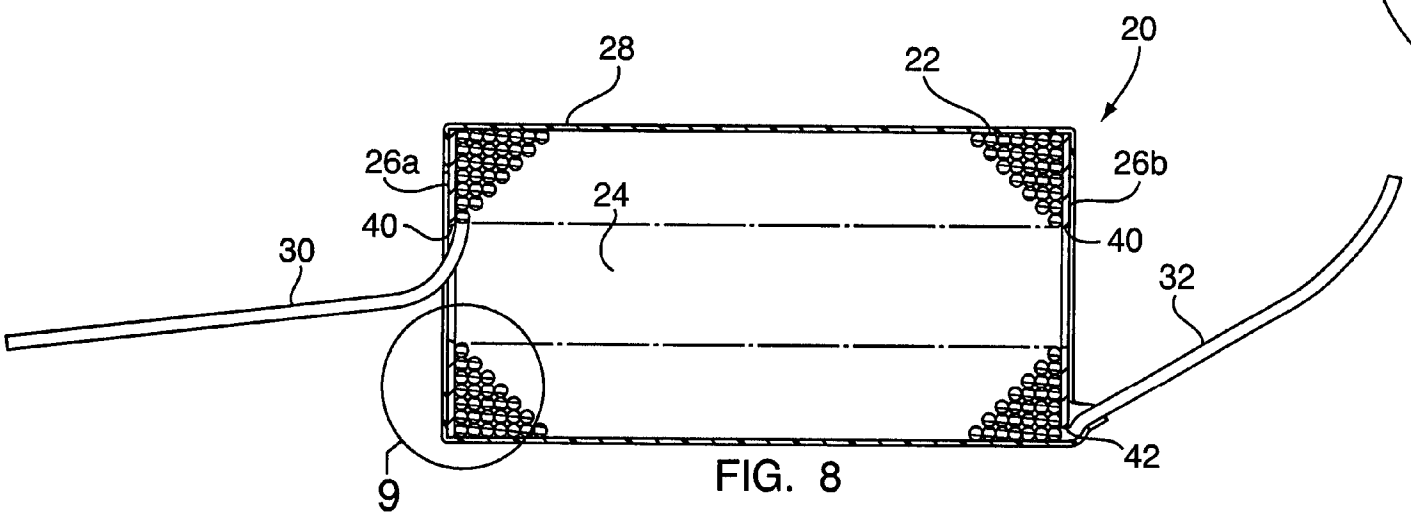
FIG. 8 is a cross-sectional view of the package system taken along line 8-8 in FIG. 7.
Figure 10:
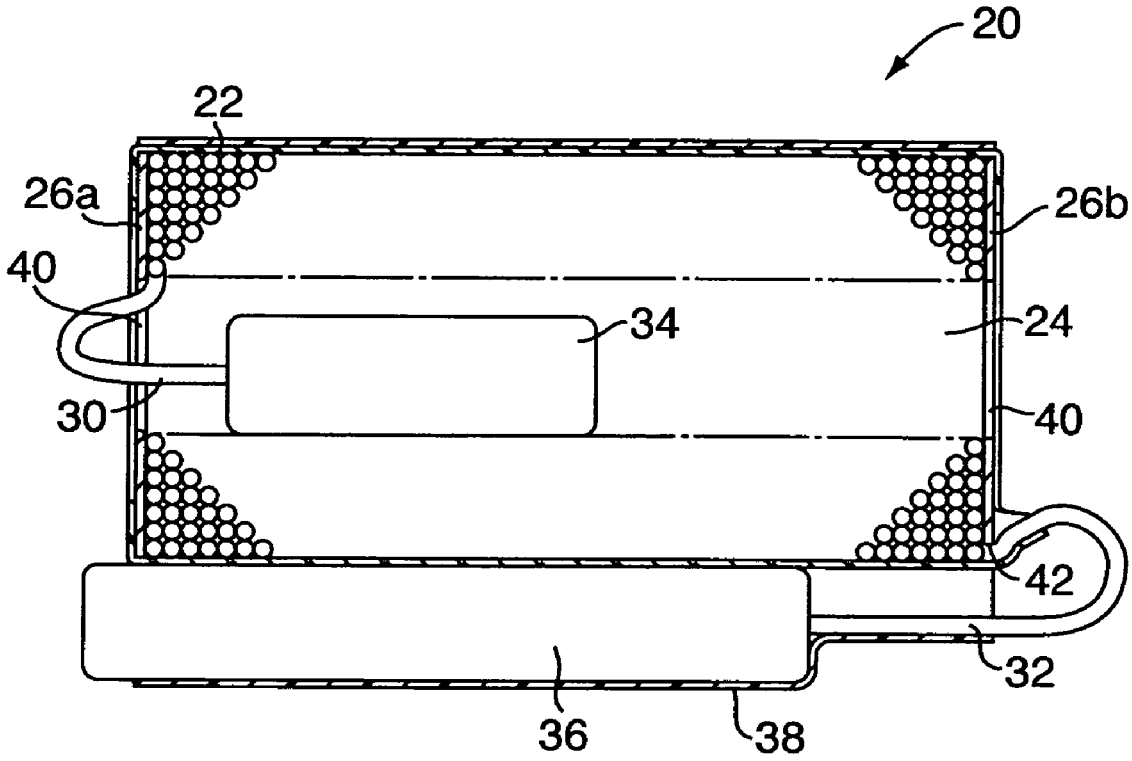
FIG. 10 is a cross-sectional view of the package system also showing a detonator and percussive initiator device.
Figure 11A:
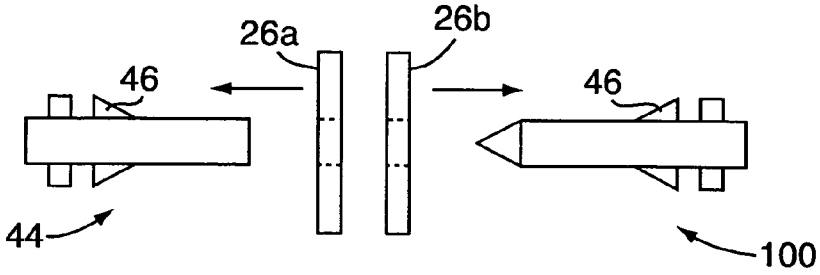
FIGS. 11*a*-11*f* are schematic diagrams of the steps of a method of manufacturing the shock tube package system.
Figure 11B:
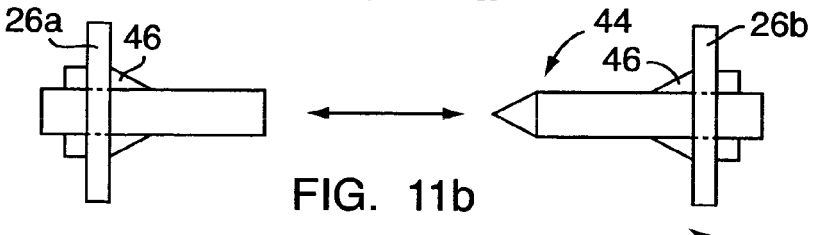
Figure 11C:
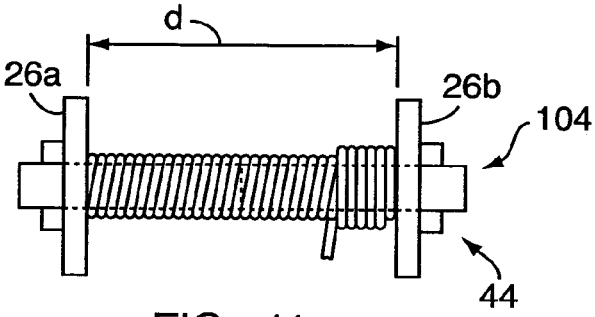
Figure 11D:
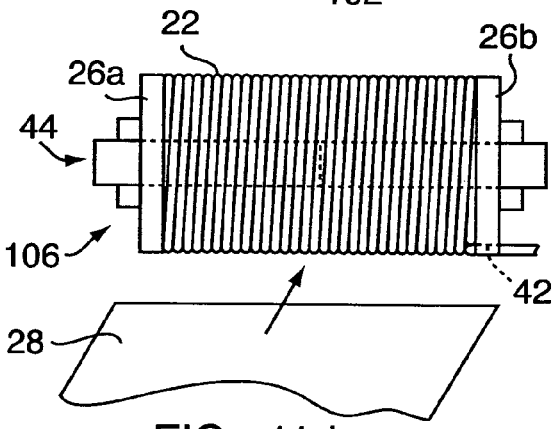
Figure 11E:
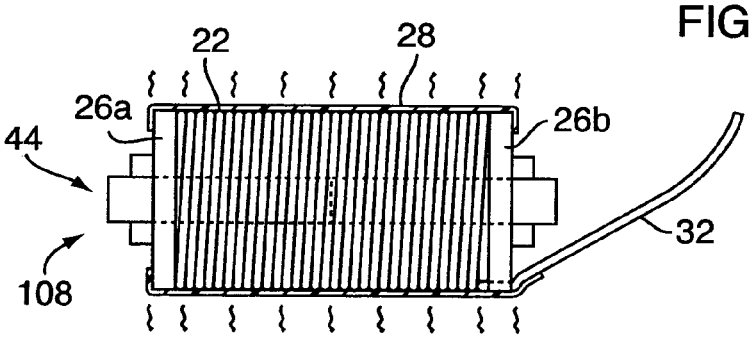
Figure 11F:
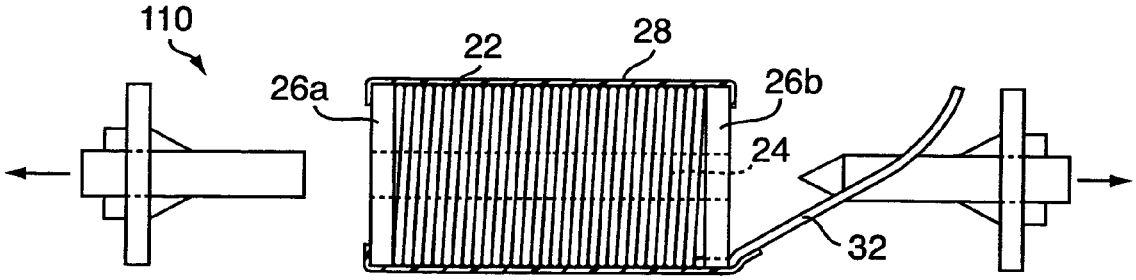

With reference to FIGS. 1-11*f*, an embodiment of the present invention relates to a coreless-coil shock tube package system 20, and to a method for packaging shock tubing. The package system 20 includes a "coreless" bundle of shock tubing 22, by which it is meant that the tubing bundle 22 is not supported or contained by being wrapped around a spool or other supporting structure. The tubing bundle may be a generally cylindrical (in overall shape) coil of shock tubing. Optionally, two washer-like end caps or plates 26*a*, 26*b* abut the ends of the tubing coil 22 for helping to support the coil axially. Also, a polymer, "shrink wrap" or other type outer cover or envelope 28 at least partially covers the coil 22 and end plates 26*a*, 26*b*.

Typically, one end of the tubing 22 (the "inner" end 30) is positioned at the interior 24 of the coil 22, and the other end of the tubing (the "outer" end 32) is positioned on the outside of the coil. Optionally (see FIG. 10), a detonator 34 is attached to the tubing's inner end 30 and is then tucked into the coil 22, through one of the end plates 26*a*, for convenient storage and transport. Also, a percussive initiator device ("igniter") 36 may be attached to the tubing's outer end 32 and secured in place against the outer covering 28 using, e.g., a second layer of shrink wrap-type covering 38, an adhesive, or the like.

In use, the detonator 34 is removed from the coil 22 by pulling on a portion of the tubing 22 left protruding through a central hole 40 in the end plate 26*a*. Alternatively, a pull string or tab may be attached to the detonator 34 or proximate tubing for use in removing the detonator from the coil interior 24. Then, the detonator 34 is attached to an explosive device (not shown) in a conventional manner. To deploy the tubing 22, the coil package 20 is pulled away from the detonator and explosive, thereby uncoiling the tubing through the end cap 26*a* and out of the outer covering 28. Then, once at a safe distance, the igniter 36 is actuated, igniting the shock tubing 22, which in turn actuates the detonator, igniting the explosive.

The washer-like end plates 26*a*, 26*b* are generally the same size, and are thin and generally lightweight. They may be manufactured from aluminum or other lightweight material such as nylon or other polymer, or from other materials such as steel. The outer diameter of the end plates 26*a*, 26*b* generally matches that of the wound shock tube coil 22. The diameter of the end plates' central holes 40 generally corresponds to a desired diameter of the coil interior 24. The first end plate 26*a* (see FIGS. 3 and 4) has an annular configuration. The second end plate 26*b* (see FIGS. 5 and 6) may include a notch 42 for facilitating passage of the outer end 32 of the tubing 22 between the end plate 26*b* and outer covering 28. The second end plate 26*b* may or may not be provided with a central hole 40. The end plates 26*a*, 26*b* help to hold the tubing coil 22 axially. However, the end plates 26*a*, 26*b* are optional, since additional axial support may not be needed, depending on the physical characteristics of the shock tubing 22 (when coiled), the coiling method, and/or the type or configuration of outer covering 28.

The shock tube coil 22 can be any length as desired, from tens to hundreds of feet in length or more. The shock tubing 22 may be similar to that described in U.S. Pat. No. 4,328,753, or the shock tubing as described in U.S. Pat. No. 5,597,973, but with an outside diameter of approximately 0.100 inches. (These patents are hereby incorporated by reference in their entireties.) This size of small-diameter shock tubing will yield the desired degree of resiliency and stress at the inside diameter of the coiled shock tubing, after removal from a mandrel in the manufacturing method described below. However, as should be appreciated, shock tubing with different diameters may be used. Suitable shock tubing is manufactured by Shock Tube Systems, Inc. of 363 Ekonk Hill Rd., Sterling, Conn.

The outer covering 28 may be a shrink-wrap or other type polymeric film envelope that surrounds the outer edges of the end plates 26*a*, 26*b* and tubing coil 22. The outer covering 28 overlaps the end plates 26*a*, 26*b*, but does not need to extend as far as the plates' central openings 40. The optional second layer 38 for holding the igniter 36 in place is similar, but does not necessarily overlap the end plates 26*a*, 26*b*. The outer covering 28 and second layer 38 may be a heat-activated shrink-wrap polymeric film such as those available in Tyco Electronics' Raychem line.

As noted, the detonator 34 is operably connected to the inner end 30 of the coiled shock tube 22. The detonator 34 may be a device made in accordance with U.S. Pat. No. 6,272,996. Also, the detonator 34 may be positioned inside the coil 22 for reducing the volume of the resulting package 20. The igniter 36 is operably connected to the outer end 32 of the tubing 22, and is held in place by the second shrink-wrap layer 38. The igniter 36 may be a device constructed in accordance with U.S. Pat. No. 6,272,996. This patent is hereby incorporated by reference in its entirety. Optionally, the coreless-coil shock tubing package 20 may be provided without a detonator or igniter, in which case these or similar devices would be connected to the coil 22 by a user in the field or otherwise. As should be appreciated, the igniter may be attached to the coil package 22 using an adhesive, elastic bands, or the like, in the field or during manufacturing. The igniter and detonator are sometimes collectively referred to herein as "shock tube devices," by which it is meant a device either for actuating a shock tube or being acted upon by a shock tube signal.

As noted above, the shock tubing is provided as a "bundle," which refers generally to configurations where a length of shock tubing is wound in a compact manner or otherwise compactly arranged. Thus, the shock tubing bundle may be in the form of a coil, or, e.g., it could comprise successive short lengths of the tubing folded back over on one another. The bundle does not have to be cylindrical in overall shape, and could be other shapes. Thus, one embodiment of the present invention may be characterized as packaged shock tubing comprising a bundle consisting of a compactly arranged length of shock tubing (e.g., no spool or other support) and a polymer cover that maintains the length of shock tubing in a bundled manner, e.g., in a compact arrangement.

The shock tube package system 20 is optionally provided with a tear strip (not shown) integral with and/or operably attached to the outer cover 28 for quickly and easily removing the outer cover if desired. For example, for some applications, and especially those involving short lengths of shock tubing, the user may want to remove the outer cover for deploying the shock tubing 22 without having to uncoil it through end plates 26*a*, 26*b* and/or outer covering 28.

FIGS. 11*a*-11*f* show one possible method for manufacturing the shock tube package system 20. To do so, at Step 100 (FIG. 11*a*), the end plates 26*a*, 26*b* are placed on a generally cylindrical mandrel 44 so that the desired length of shock tube 22 can be wound to the diameter of the end plates. The end plates 26*a*, 26*b* are spaced apart by a distance that is a function of the end plate diameter and desired tubing length. This distance "d" can be approximated by:

$$d \approx r_o^2 \cdot L/(r_1^2 - r_2^2), \text{ where}$$

$r_o$=tubing outer radius

L=tubing length $r_1$=radius end plate (or, if no end plate, desired radius of package)

$r_2$=radius end plate hole or mandrel

The distance "d" also corresponds to the final package system 20. Step 102 (FIG. 11*b*) shows two disconnected halves of a compound mandrel being reconnected for winding the tubing 22; however, many different types of mandrels may be used and the one shown in the drawings is for illustrative purposes only (element 46 indicates retractable retainer clips).

Next, at Step 104 (FIG. 11*c*), the tubing 22 is wound around the mandrel 44 between the end plates 26*a*, 26*b*, while assuring that the outside diameter of the end plates corresponds to that of the outside diameter of the coil. Then, at Step 106 (FIG. 11*d*), the outer covering 28 is wrapped around the tubing 22 and at least the peripheral portions of the ends plates 26*a*, 26*b*. Then, at Step 108 (FIG. 11*e*), heat is applied to the covering 28, if a heat-activated shrink-wrap covering is used. Finally, at Step 110 (FIG. 11*f*), the mandrel 44 is removed.

As an alternative to the type of mandrel shown in FIG. 11, a slightly tapered, one-piece mandrel could be used, with the diameters of the central holes in the end plates varying slightly from one another to correspond to the tapered mandrel for easy spacing and registration of the end plates on the mandrel. As should be appreciated, tapering also helps with removing the mandrel from the wrapped bundle/coil.

Optionally, a detonator 34 is attached to the inner end 30 of the tubing 22 and inserted into the opening provided at one end of the coil 22. Also, an igniter 36 may be attached to the outer end 32 of the tubing 22 and optionally retained by the second shrink-wrap layer or covering 38 surrounding the shrink-wrapped coil 22.

As should be appreciated, instead of tucking in whichever device is attached to the inner tubing end, such device can be left on the outside of the coil and removably secured to, e.g., the end of the coil. Also, for use in certain applications, instead of attaching a detonator 34 to the inner end 30 of the tubing 22 and an igniter 36 to the outer end 32 of the tubing 22, the igniter may be attached to the inner end and the detonator to the outer end. In this configuration, the detonator and coil would remain with the explosive device while the igniter is moved away from both. It might also be the case that the igniter would remain stationary (e.g., held by a soldier or other user) while the coil and detonator are moved in a direction of interest.

With or without the end caps 26*a*, 26*b*, the above-described method results in a convenient package that avoids the need for a bulky spool, thereby providing a lightweight and compact assembly that can be easily transported by those in the field. This method, and the product made in accordance with the method, obviates the need for relatively heavy spools of the type formerly used to provide the explosives expert in the field with shock tube in an easily transportable form.

The advantages of the present invention can be optimized if shock tubing of a minimum size is wound on a mandrel of minimum diameter. The above-noted small-diameter size shock tubing can yield a product of minimum dimensions (that is, where the inside diameter is just large enough to accommodate a typical detonator, and where the outside diameter is on the order of 2 inches or less). Thus, if the diameter of the end plate central opening 40 is approximately 0.75 of an inch, the outside diameter of the entire assembly 20 can be 2 inches or less. The axial length of a coil of these proportions will be dictated by the length of the shock tube to be accommodated, but typically can be on the order of approximately 4 to 6 inches in length, given the seven layers of tubing which can be wound within these parameters using small-diameter shock tubing.

Although the present invention has been described as having a polymer outer covering 28, other materials could be used for the outer covering. For example, foil, textile, mesh, paper, etc. outer coverings could also be used.

Since certain changes may be made in the above-described coreless-coil shock tube package system and method of manufacturing, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A shock tube package system comprising:

a generally cylindrical coil of shock tubing having a lateral side surface and two end surfaces, said cylindrical coil of shock tubing defining a longitudinal open interior space;

an envelope covering the lateral side surface and at least part of both end surfaces of the bundle of shock tubing;

first and second end plates respectively abutting the end surfaces of the coil of shock tubing and disposed between the coil and envelope, the first end plate having a central opening for accessing the interior space, and a first end of the shock tubing being accessible through the central opening in the first end plate;

a shock tube device operably connected to the first end of the shock tubing and tucked into the interior space of the coil of shock tubing through the central opening in the first end plate; and a second shock tube device operably connected to a second end of the shock tubing and attached to an outside of the envelope.

2. The shock tube package system of claim 1 wherein:

the second end plate is provided with an outer notch for facilitating passage of the second end of the shock tubing between the envelope and second end plate.

3. The shock tube package system of claim 1 wherein:

the second shock tube device is attached to the outside of the envelope by a second envelope.

4. The shock tube package system of claim 1 wherein:

the coil of shock tubing defines a longitudinal open interior space;

a first end of the shock tubing is accessible through the interior space; and the system further comprises a shock tube device operably connected to the first end of the shock tubing and tucked into the interior space of the coil of shock tubing.

5. The shock tube package system of claim 4 further comprising:

a second shock tube device operably connected to a second end of the shock tubing and attached to an outside of the envelope.

6. The shock tube package system of claim 5 wherein:

the second shock tube device is attached to the outside of the envelope by a second envelope.

7. The shock tube package system of claim 1 wherein the envelope is a polymer envelope comprising at least one layer of heat shrink wrapping.

* * * * *